US006502333B1

(12) United States Patent
Striegel

(10) Patent No.: US 6,502,333 B1
(45) Date of Patent: Jan. 7, 2003

(54) PIPELINE PADDING MACHINE AND METHOD

(76) Inventor: Randall R. Striegel, 3612 Country Rd. 231, Lyman, WY (US) 82937

( * ) Notice: Subject to any disclaimer, the term of this patent is extended or adjusted under 35 U.S.C. 154(b) by 0 days.

(21) Appl. No.: 09/362,990

(22) Filed: Jul. 27, 1999

Related U.S. Application Data

(60) Provisional application No. 60/094,485, filed on Jul. 29, 1998.

(51) Int. Cl.[7] ..... E02F 5/22
(52) U.S. Cl. ..... 37/142.5; 405/179
(58) Field of Search ..... 37/142.5; 405/179

(56) References Cited

U.S. PATENT DOCUMENTS

| | | | | |
|---|---|---|---|---|
| 2,947,096 | A | 8/1960 | Cummings et al. | 37/144 |
| 3,596,384 | A | 8/1971 | Neujahr | 37/142.5 |
| 3,701,422 | A | 10/1972 | Downey | 209/241 |
| 3,981,089 | A | 9/1976 | Burrows | 37/142.5 |
| 4,055,255 | A | 10/1977 | Vasquez | 214/2 |
| 4,055,265 | A | 10/1977 | Eisenman | 214/17 |
| 4,057,917 | A | 11/1977 | Burrows | 37/195 |
| 4,301,910 | A | 11/1981 | Price | 198/304 |
| 4,377,365 | A | 3/1983 | Layh | 414/334 |
| 4,616,957 | A | 10/1986 | Burrows et al. | 405/179 |
| 4,633,602 | A | 1/1987 | Layh et al. | 37/195 |
| 4,664,791 | A | 5/1987 | McClain et al. | 209/421 |
| 4,861,461 | A | 8/1989 | Utterback | 209/234 |
| 4,912,862 | A | 4/1990 | Bishop et al. | 37/142.5 |
| 4,948,299 | A | 8/1990 | Cronk, Jr. et al. | 405/179 |
| 4,955,756 | A | 9/1990 | Klamar | 405/179 |
| 5,084,991 | A | 2/1992 | Cronk, Jr. | 37/142.5 |
| 5,097,610 | A | 3/1992 | Bishop | 37/142.5 |
| 5,120,433 | A | 6/1992 | Osadchuk | 209/235 |
| 5,183,160 | A | 2/1993 | McClain | 209/234 |
| 5,195,260 | A | 3/1993 | Osadchuk | 37/142.5 |
| RE34,289 | E | 6/1993 | McClain et al. | 209/421 |
| 5,259,699 | A | 11/1993 | Klamar | 405/179 |
| 5,261,171 | A | 11/1993 | Bishop | 37/142.5 |
| 5,271,168 | A | 12/1993 | Wilson, Sr. et al. | 37/142.5 |
| 5,363,574 | A | 11/1994 | Osadchuk | 37/142.5 |
| 5,421,108 | A | 6/1995 | Stewart | 37/142.5 |
| 5,430,962 | A | 7/1995 | Osadchuk | 37/142.5 |
| 5,479,726 | A | 1/1996 | Bishop | 37/142.5 |
| 5,540,003 | A | 7/1996 | Osadchuk | 37/142.5 |
| 6,138,837 | A | 10/2000 | Santa Cruz et al. | |

OTHER PUBLICATIONS

Ozzie's Pipeline Padder, Mini Padder B–4 Ozzie's Pipeline Padder, Inc., Scottsdale, Arizona.

(List continued on next page.)

*Primary Examiner*—Christopher J. Novosad
(74) *Attorney, Agent, or Firm*—Mallinckrodt & Mallinckrodt

(57) ABSTRACT

A self-propelled pipeline padding machine and a method for padding pipelines in ditches without damaging the pipeline prior to backfilling of the ditch. A spoils pile comprising dirt, various size rocks, and sand taken from the ditch during the digging thereof lie in a generally continuous pile along side the ditch from the excavation thereof. The machine includes an excavator having an arm with end bucket for scooping up material from the spoils pile on the opposite side of the ditch and placing it into frame mounted padding material sorter mounted to the front of the excavator. The separated padding material falls onto a laterally disposed retractable conveyor below the sorter which moves the padding material onto the pipeline in the ditch ahead of the excavator. The residual rocks and debris fall between the tracks of the excavator. The sorter can be tilted using hydraulic cylinders between the frame supporting the sorter and the undercarriage of the excavator. The padding material is deposited ahead of the excavator such that any rocks or debris inadvertently knocked or dropped into the ditch fall on already padded pipeline. The method includes depositing padding material onto a pipeline.

26 Claims, 8 Drawing Sheets

OTHER PUBLICATIONS

Figure 1:
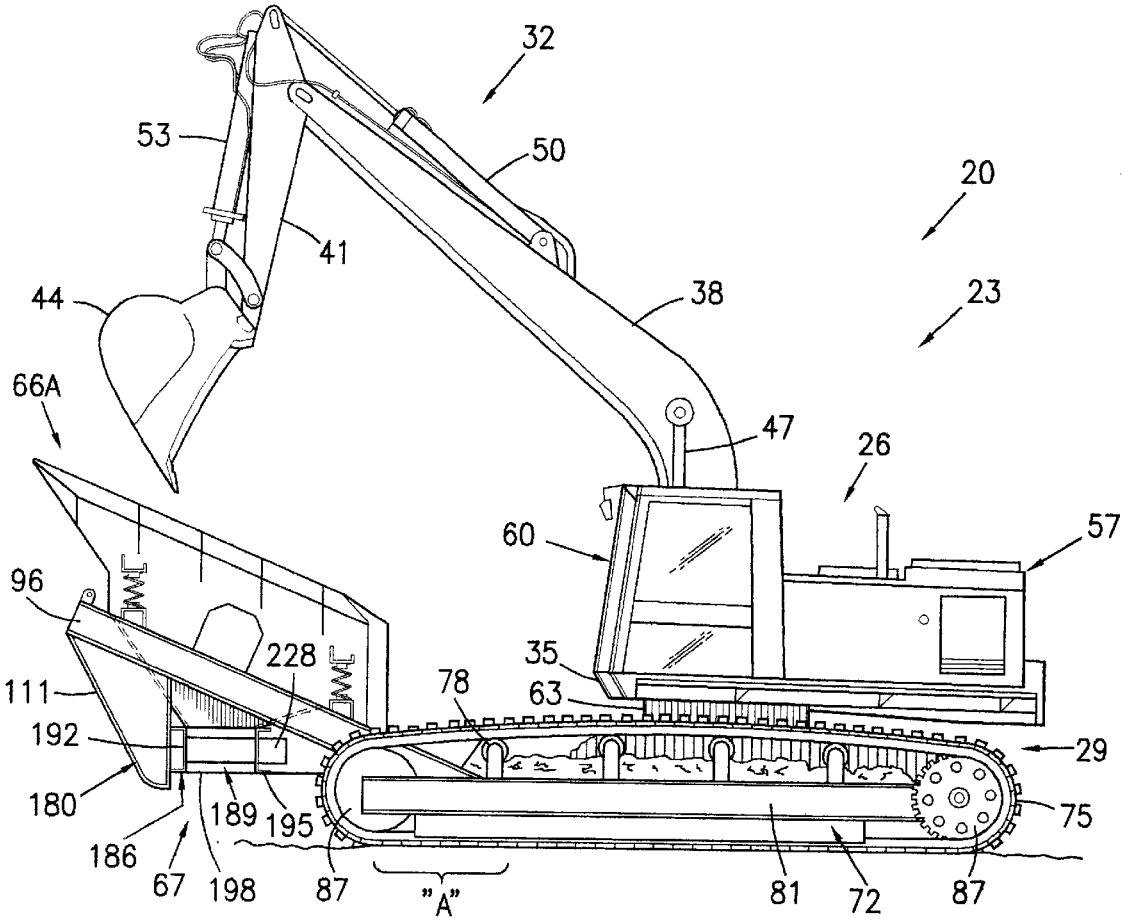

Rockeater, The Original Self Contained Pipeline Padding Machine Rockeater Incorporated, Hobbs, New Mexico.

Dynapad Pipeline Padding Systems KNI Incorporated, Homer City, Pennsylvania.

The Ultimate Padder (Front and Rear Views) Ozzie's Pipeline Padder, Phoenix, Arizona.

Universal Wobbler Feeders Universal Engineering Corporation, Cedar Rapids, Iowa.

Contractor Profile "Ozzie's Pipeline Padder Provides Needed Machine" Pipeline & Gas Journal Aug. 1993.

Ozzie's Pipeline Padder, Mini Padder B–5 Ozzie's Pipeline Padder, Inc., Scottsdale, Arizona.

Ozzie's Pipeline Padder, The Ultimate Padder Ozzie's Pipeline Padder, Inc., Scottsdale, Arizona.

Padmaster, Ray McClain, Inc., Tulsa, Oklahoma.

Ozzie's Pipeline Padder, Mini Padder A–5 Ozzie's Pipeline Padder, Inc., Scottsdale, Arizona.

Ozzie's Pipeline Padder, OPP–300 Ozzie's Pipeline Padder, Inc., Scottsdale, Arizona.

Ozzie's Pipeline Padder, OPP–200 Ozzie's Pipeline Padder, Inc., Scottsdale, Arizona.

Cost Saving Machine Aids Pipeline Industry, vol. 8, Number 1 First Quarter 1993, Kaman News.

PIPELINE PADDING MACHINE AND METHOD

RELATED APPLICATION

This application claims the benefit of U.S. Provisional Application No. 60/094,485 filed by Express Mail on Jul. 29, 1998.

SPECIFICATION

BACKGROUND OF THE INVENTION

1. Field

The invention is in the field of machines and methods for padding pipelines, and more particularly to self-propelled padding machines and methods which utilize a single machine which scoops up the spoils, separates out padding material, and deposits such padding material on the pipeline.

2. State of the Art

When a long pipeline is to be laid such as a cross country gas or oil pipeline many miles in length, an excavator or other such device digs an elongate ditch into which the pipeline is to be subsequently laid. The dirt and rocks removed during the digging of the ditch, the spoils material, is typically dumped in a more or less continuous pile adjacent the ditch called the spoils pile. After the pipeline has been placed in the ditch, typically on sand bags or other supports, the pipeline is initially covered with only loose dirt and small rocks separated from the spoils material, called padding, which padding protects the pipeline when the residual material which remains after separating padding therefrom including rocks and other such material which is dumped on top of the pipeline to backfill the remainder of the ditch. This use of padding material is especially important to protect the outer coating applied to many modern pipelines which coating provides corrosion resistance thereto.

There are a number of different types of motorized pipeline padding devices such as for use such as for padding cross country gas and oil supply pipelines. A first type is disclosed in U.S. Pat. Nos. 5,120,433; 5,195,260; 5,363,574; and 5,430,962 all issued to Osadchuk. The pipeline padding machine comprises a tracked vehicle having a pair of vertically extending, ground level front projections which when driven against the spoils pile funnel the spoils material onto an elevator which carries the spoils material over the top and to the rear of the vehicle into a sorter. The sorter separates padding material from other residual material and deposits separated padding material onto a conveyor which laterally transports the padding material into the ditch onto the pipeline. The residual material such as rocks and other debris are deposited onto the ground behind the vehicle. Since the projections are mounted to the front of the vehicle but the padding material is deposited onto the pipeline at the rear of the vehicle, rocks are frequently knocked onto the unpadded portion of the pipeline causing damage thereto. Such padding machine cannot handle rocks of a larger size which can necessitate separating out such large rocks from the spoils pile prior to use thereof or the use of a separate excavator or similar machine to clear such large rocks therefrom when encountered.

A second type of pipeline padding machine which is separate from but attaches to a motorized vehicle is disclosed in U.S. Pat. Nos. 5,097,610; 5,261,171; and 5,479,726 all issued to Bishop. The pipeline padding machine attaches to the shovel of a tracked bulldozer with a pair of front projections which when driven against the spoils pile funnel the spoils material onto a screening belt which allows padding material to fall onto a longitudinally extending conveyor belt thereunder. The conveyor conveys the residual material into the shovel of the bulldozer or onto a separate laterally extending conveyor belt for subsequent backfilling of the ditch. The padding material on the conveyor belt drops padding material onto a laterally extending conveyor belt which drops the padding material onto the pipeline adjacent the rear of the padding machine. This version suffers from the problem of the padding machine of Osadchuk of damaging the pipeline by inadvertently knocking rocks onto the unpadded portion of the pipeline. An alternate version of the padding machine further includes a generally longitudinally forward extending conveyor belt which conveys the padding material from the laterally extending conveyor belt onto the pipeline slightly ahead of the front projections presumably in an effort to solve such problem. Such padding device still suffers from the other problem of the padding machine of Osadchuk of not being able to handle large rocks. A third type of pipeline padding machine is disclosed in U.S. Pat. No. 5,084,991 issued to Cronk, Jr., which mounts to a tracked bulldozer in place of the shovel and which can be moved vertically and tilted as normally done with the shovel replaced thereby. Such padding machine comprises a longitudinally disposed drum in a frame attached to the bulldozer which drum is rotationally powered. The exterior of the drum includes a screen to pass padding material but not larger spoils material and a plurality of paddles to engage the spoils material and propel such spoils material against the screen. A laterally extending conveyor belt extends outwardly from inside the drum to receive padding material and convey such padding material laterally onto the pipeline in the ditch. The conveyor is disposed behind the front portion of the drum and cannot accept medium sized and larger rocks, therefore suffering from the aforementioned disadvantages of the other prior art padding machines.

Other pipeline padding machines include a pipeline padding machine comprising a sorter which attaches to the side of a tractor by means of a frame and which extends over the ditch which is disclosed in U.S. Pat. No. Re. 34,289 issued to McClain et al. The sorter must be loaded by a separate bulldozer, excavator, or other such device. A similar type padding machine for attachment to the side of a tractor is disclosed in U.S. Pat. No. 4,955,756 issued to Klamar. In U.S. Pat. No. 4,616,957 issued to Burrows et al. is a pipeline padding machine which comprises a sorter and conveyor which mounts to a tracked bulldozer in place of the shovel similarly to that of Cronk, Jr. and which can be loaded by a dump truck in front of the padding machine. A motorized pipeline padding machine having a laterally disposed front feed screw, a system of conveyors, and a sorter is disclosed in U.S. Pat. No. 4,912,862 issued to Bishop et al. A longitudinally forwardly extending conveyor deposits padding material onto the pipeline adjacent the feed screw.

There are various types of sorters known in the art for separating suitable padding material such as dirt and small rocks from larger material not suitable for padding pipelines such as larger rocks, clods of dirt, and other such residual material which might damage an unpadded pipeline. Examples of such include wobbler type sorters which have a plurality of spaced, laterally disposed oblong cross-section wobbler members which rotate ninety degrees out of phase with adjacent wobblers to agitate and transport spoils material while allowing suitable padding material to fall therebetween. A second type of sorter is a vibratory type sorter which typically utilizes a vibrating frame having stacked from top to bottom a grizzly having plurality of spaced bars to exclude larger rocks and other material, and one or more screens which pass only spoils material of a predetermined size so as to pass only suitable padding material through the finest thereof.

SUMMARY OF THE INVENTION

The invention comprises a self-propelled pipeline padding machine and a method for padding pipelines without damaging the pipeline by the detrimental impact of rocks or other such material. The pipeline padding machine comprises a motorized vehicle, a sorter means attached to an end of the vehicle such as by a frame means, a loading means attached to the vehicle of such configuration to permit scooping up spoils material from the spoils pile on the same side, from the opposite side, or from both sides of the ditch from the padding machine and for dumping the spoils material into the sorter means, and a chute or conveyor means supported by the frame means which receives padding material from the sorter means and which transports the padding material into the ditch to the side and generally ahead of the vehicle such that rocks and other such debris inadvertently knocked into the ditch such as during the scooping of spoils material falls on the portion of the pipeline which has already been padded. The sorter preferably can be positioned vertically, such as by tilting, using an elevating means so as to adjust for the height of the surface of the ground.

The method of the invention for padding pipelines disposed in an elongate ditch with the spoils material removed during the digging thereof being in an elongate, generally continuous spoils pile or a series of spoils piles alongside the ditch, wherein a portion of the pipeline is unpadded and a portion of the pipeline is already covered with padding material. The method comprises the steps of (a) scooping up spoils material from the spoils pile adjacent the padded portion of the pipeline, moving such spoils material to a sorter, and depositing the spoils material into the sorter, (b) separating padding material from the residual material such as rocks and other debris inside the sorter, which is positioned adjacent the padded portion of the pipeline, (c) conveying the separated padding material from the sorter into the ditch on top of the unpadded portion of the pipeline and slightly overlapping the padded portion of the pipeline immediately adjoining the unpadded portion of the pipeline. Such steps are conducted concurrently, sequentially, or in the order required to fit the particular pipeline padding job or application, while moving continuously and/or intermittently alongside the ditch travelling generally parallel to the ditch in a predetermined direction so as to remain adjacent the padded portion of the pipeline such that rocks and/or other such materials which could damage the pipeline which are inadvertently knocked into the ditch during padding thereof primarily land on the padded portion of the pipeline so as to not damage the pipeline and any protective coating thereon.

THE DRAWINGS

Figure 4:
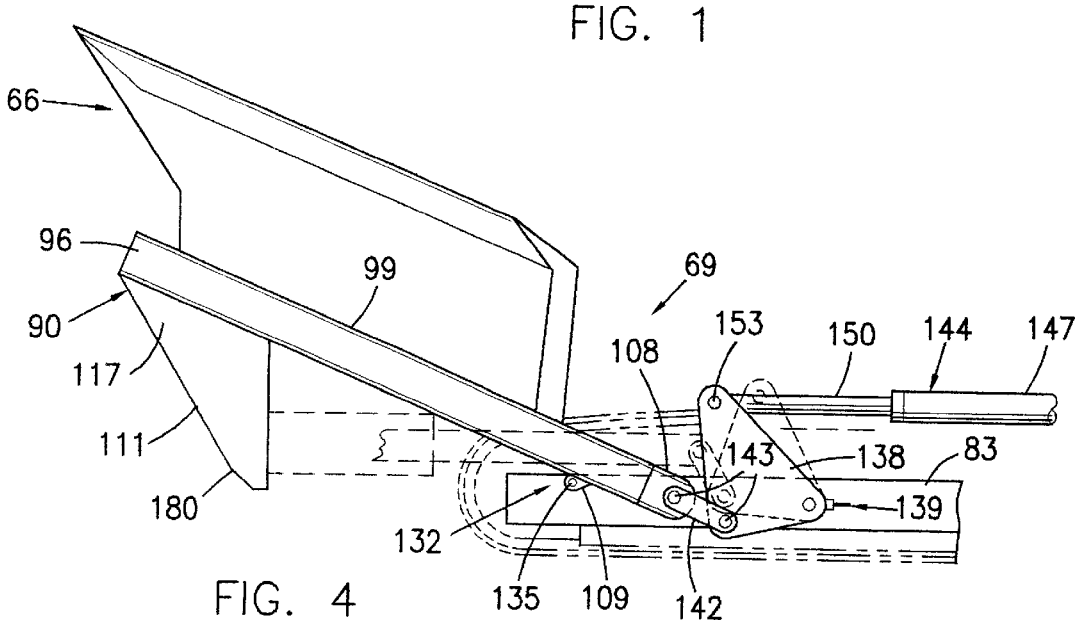
Figure 2:
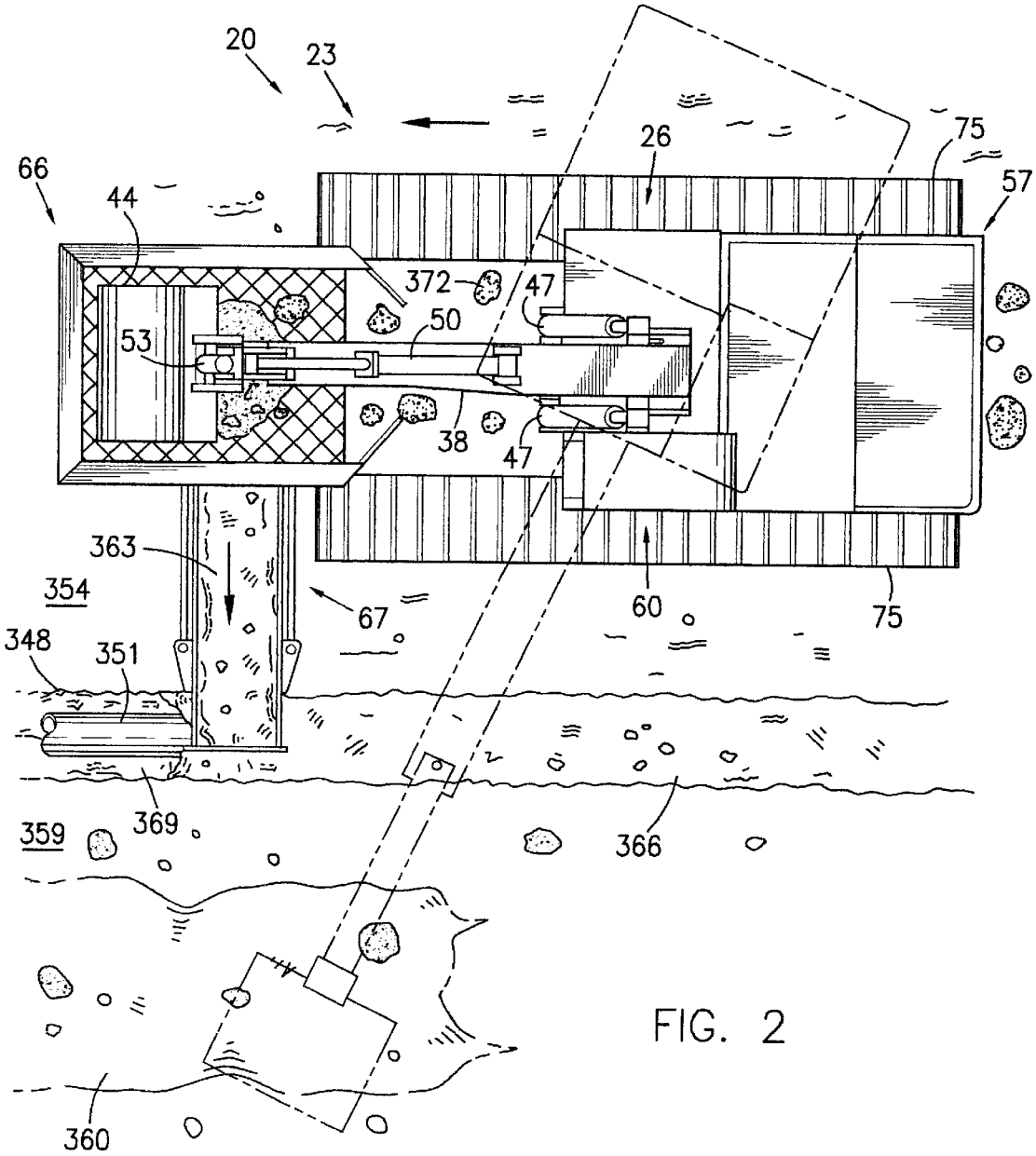
Figure 12:
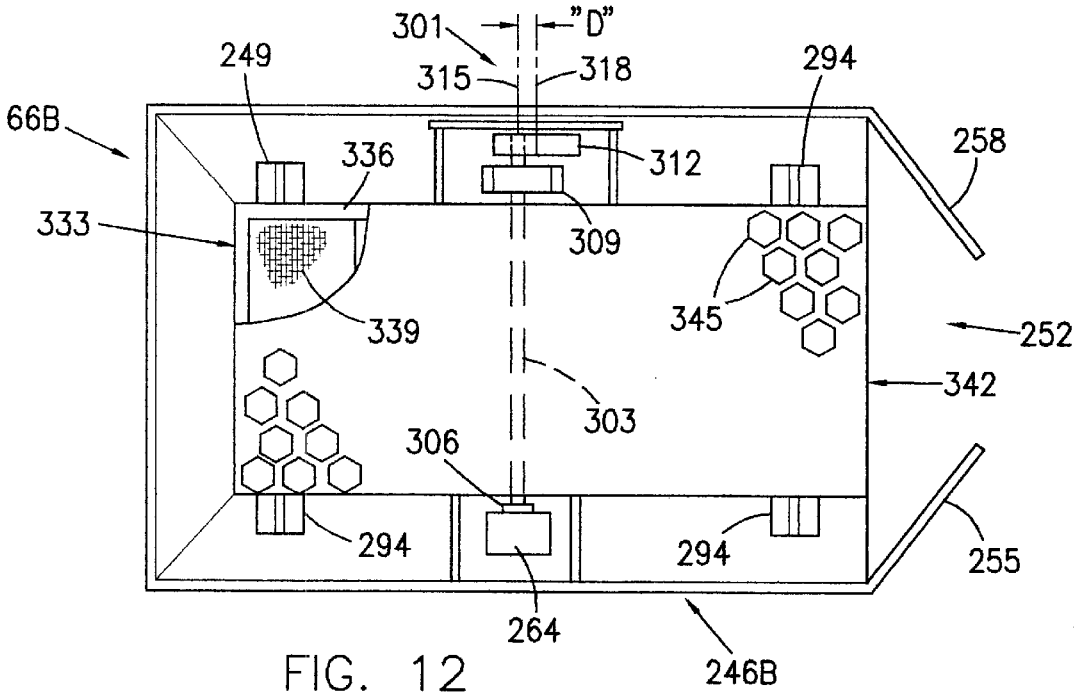
Figure 3:
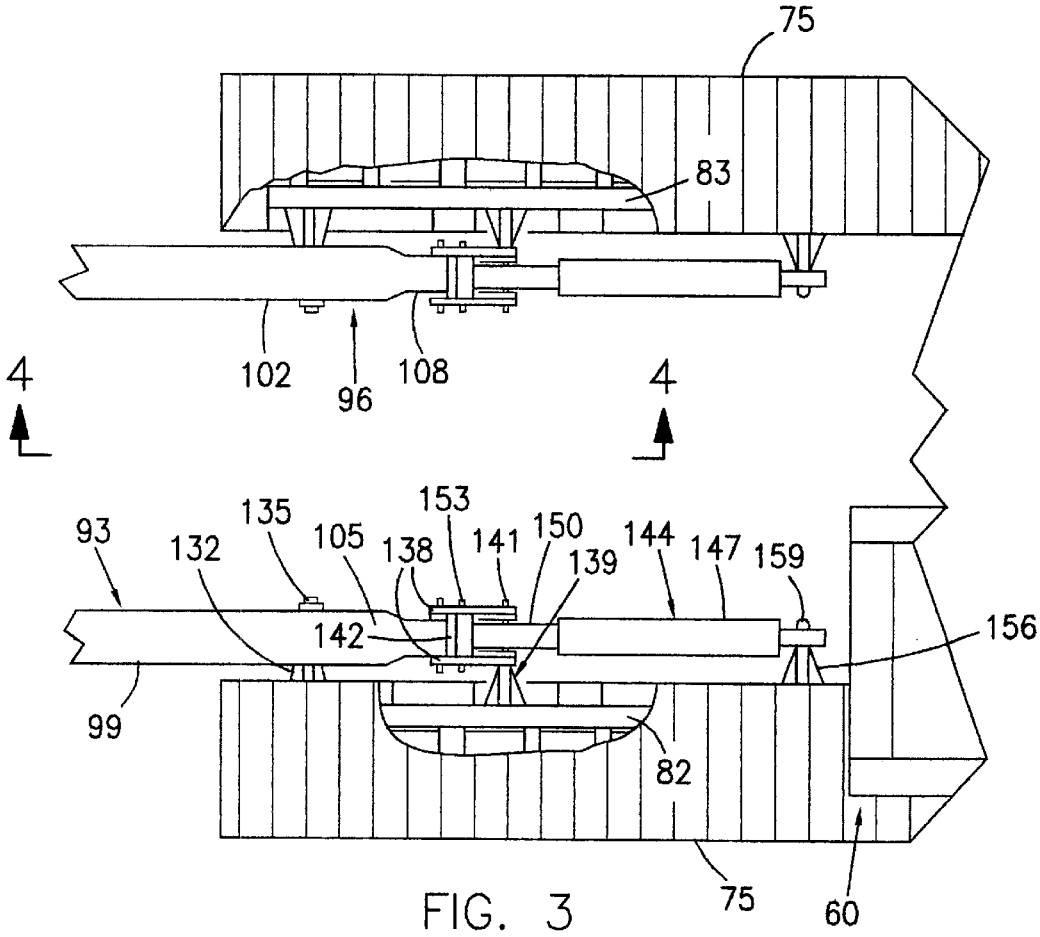
Figure 5:
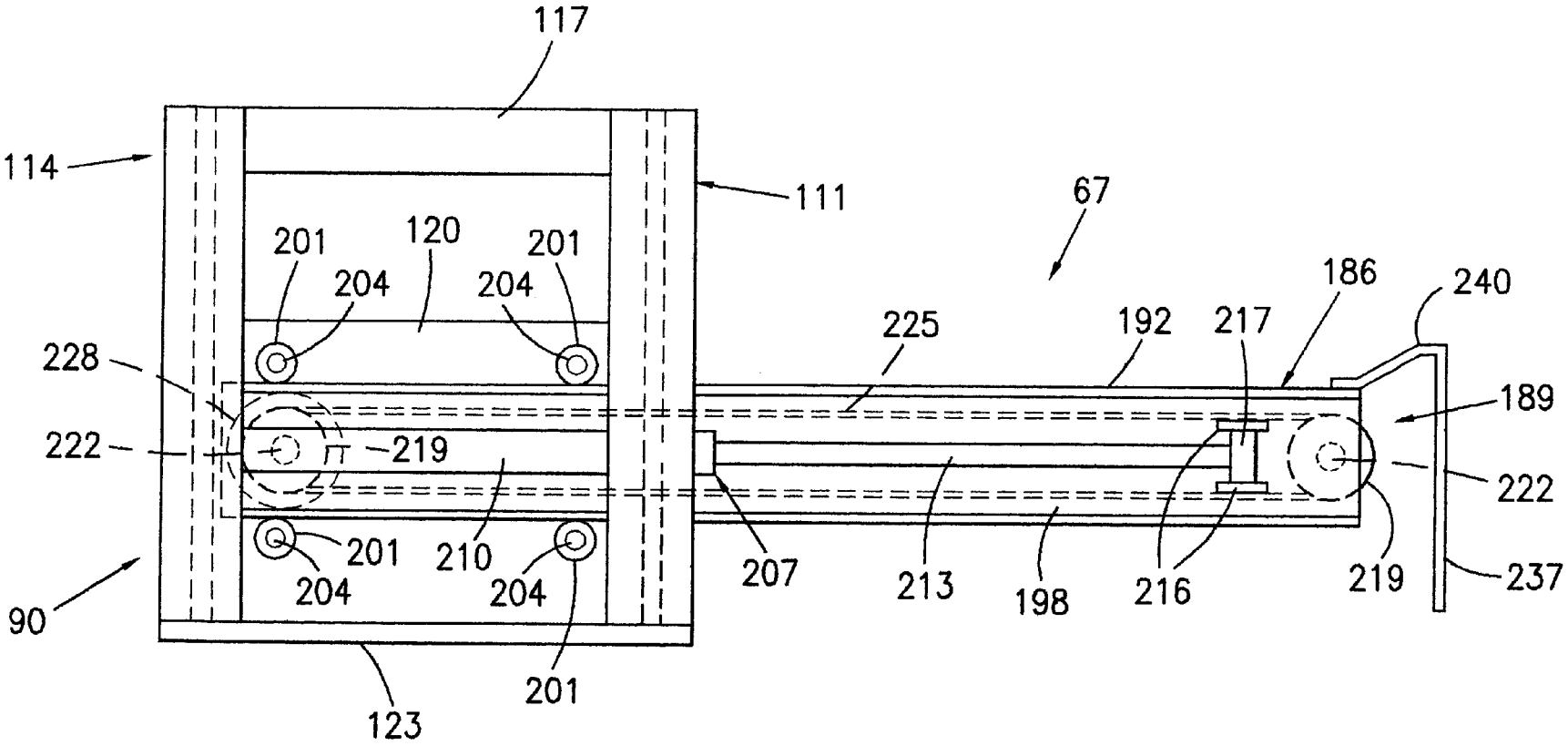
Figure 9:
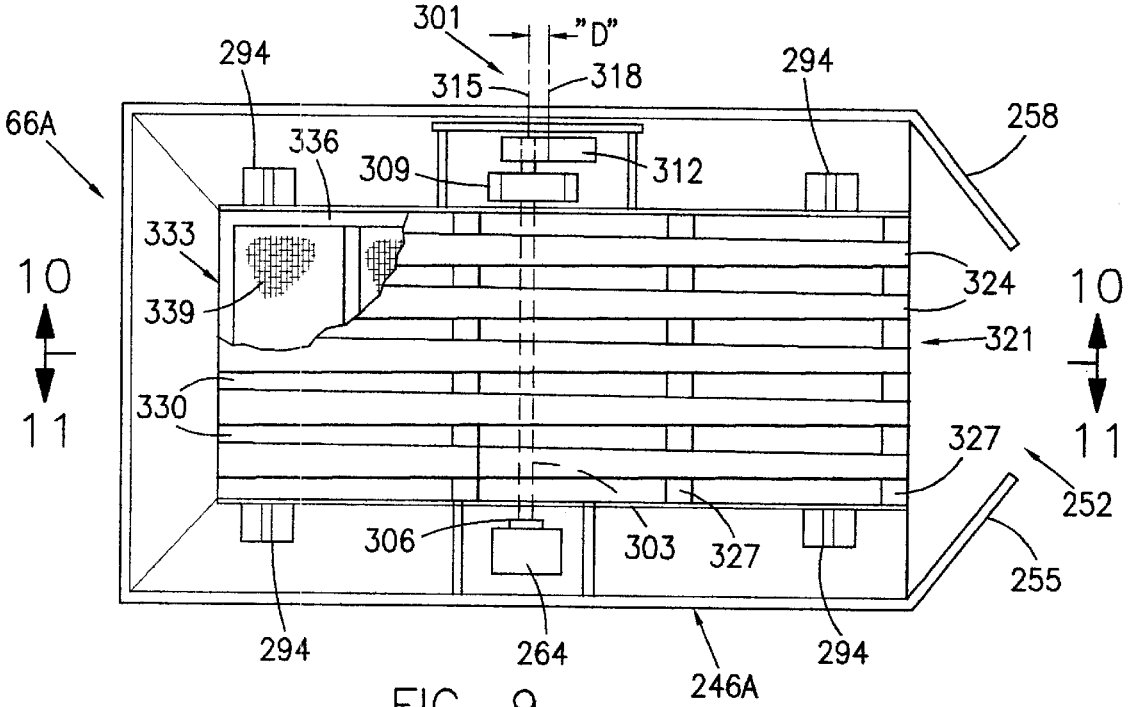
Figure 6:
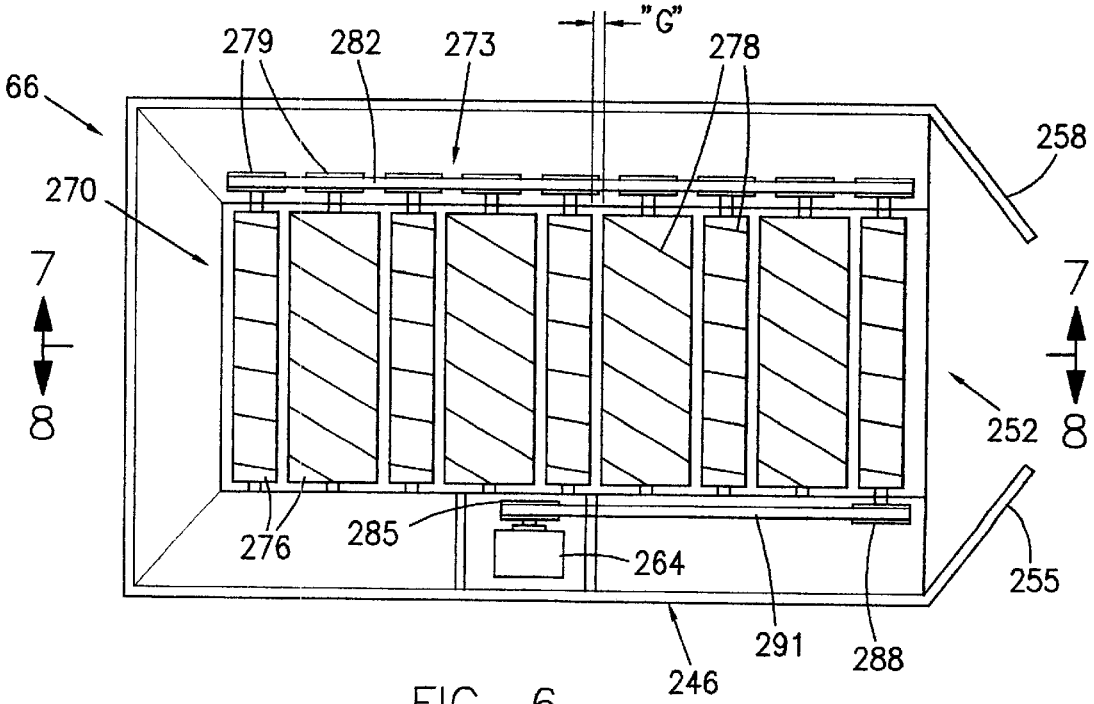
Figure 10:
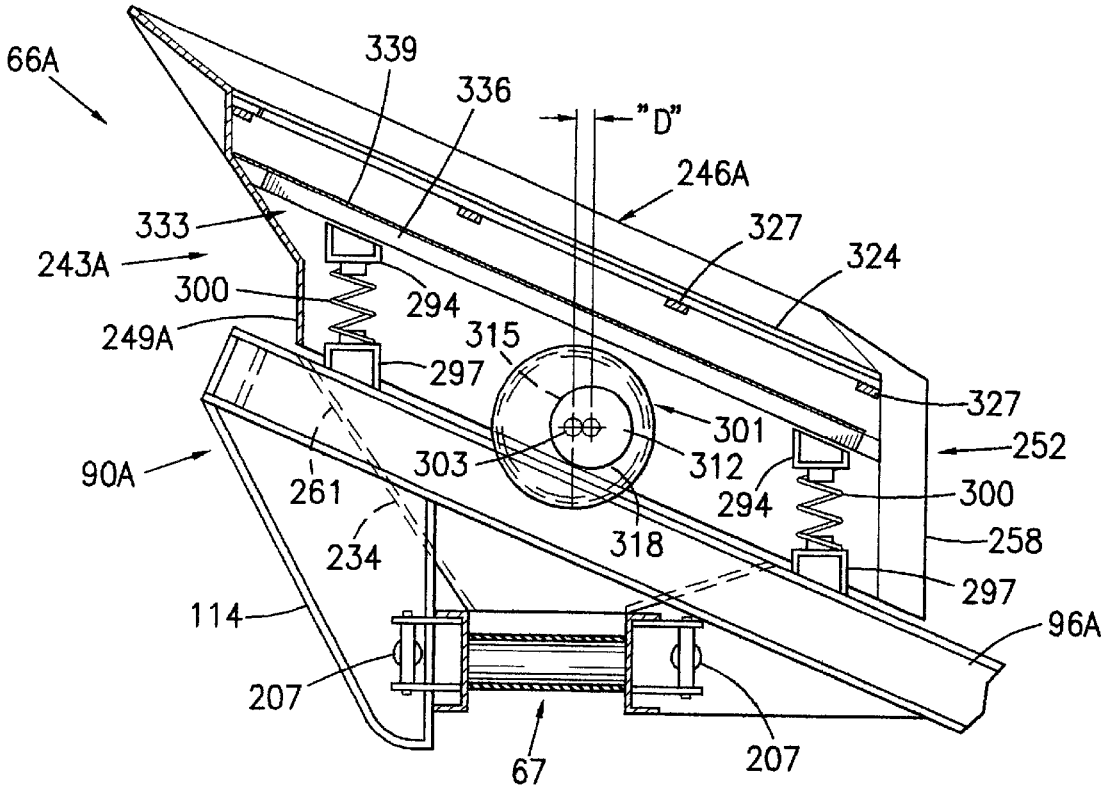
Figure 7:
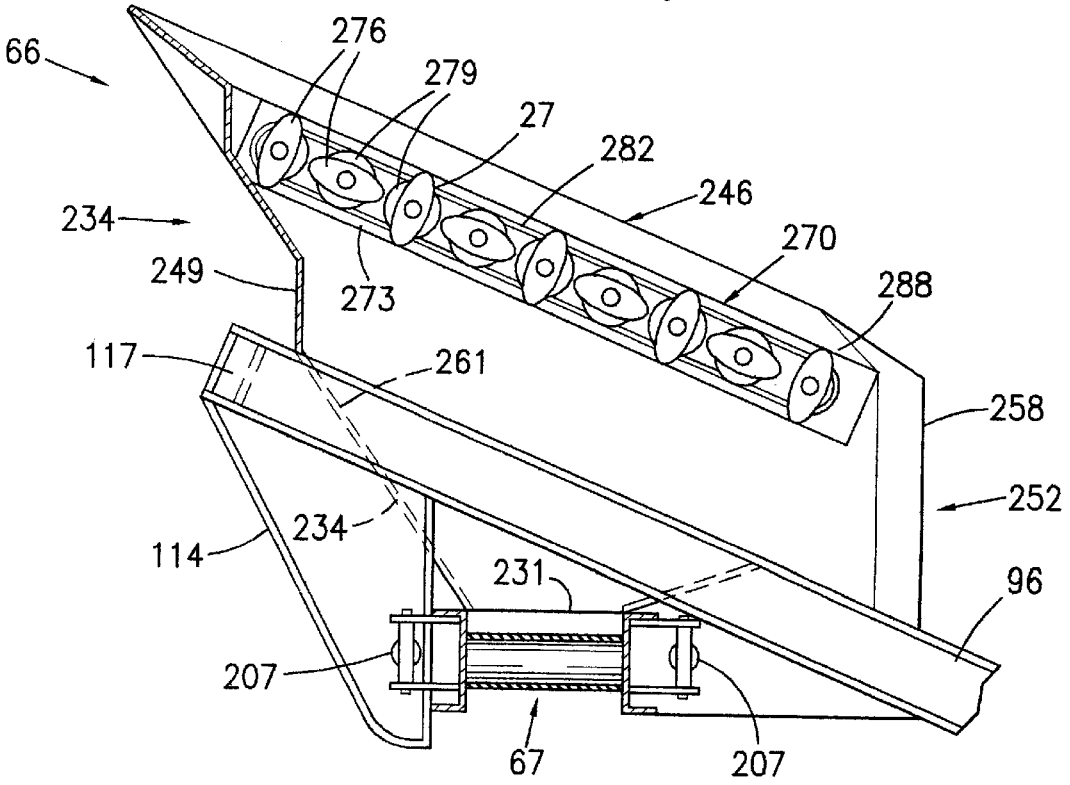
Figure 11:
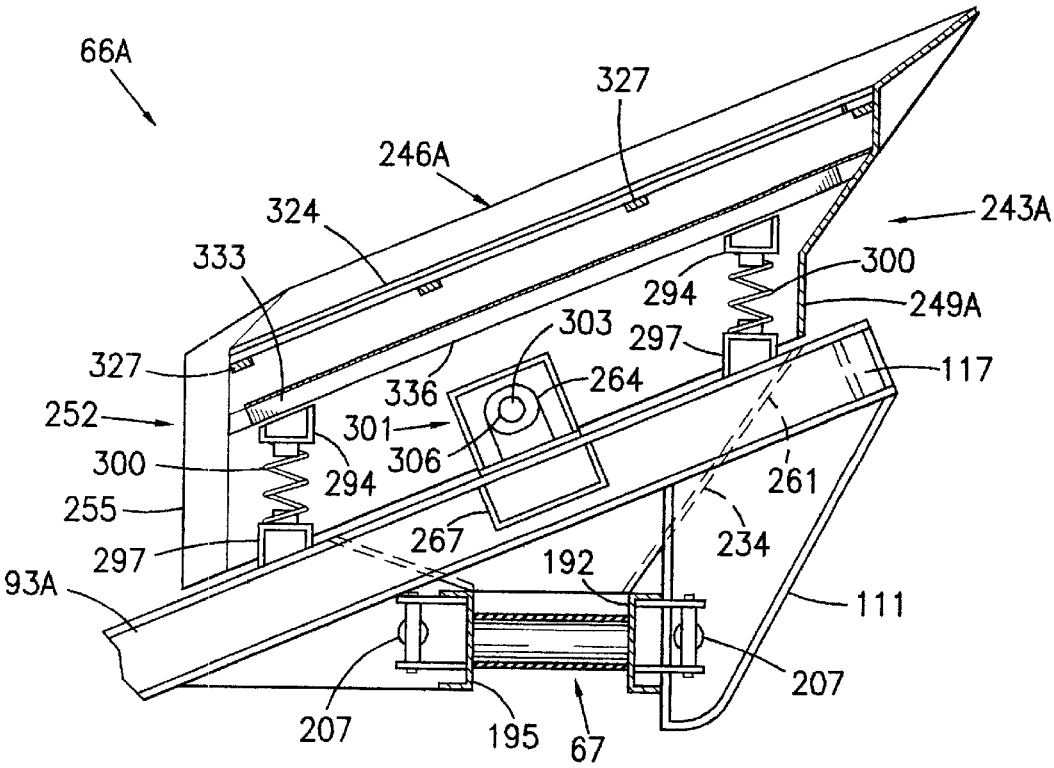
Figure 8:
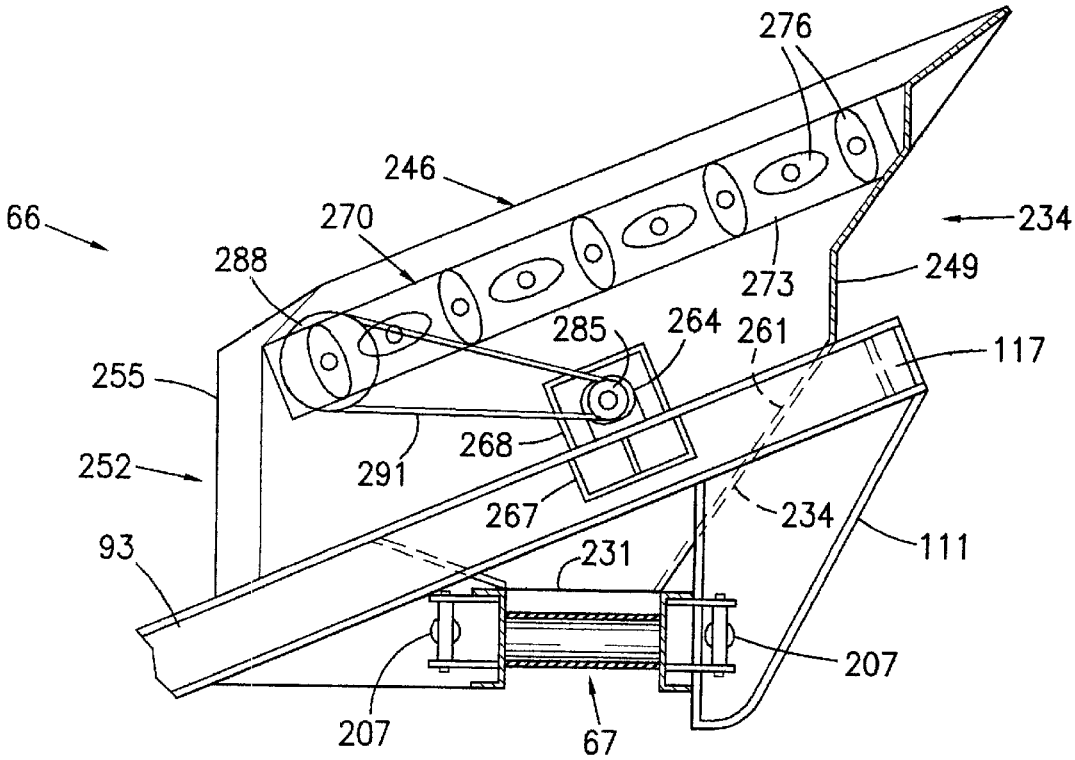
Figure 13:
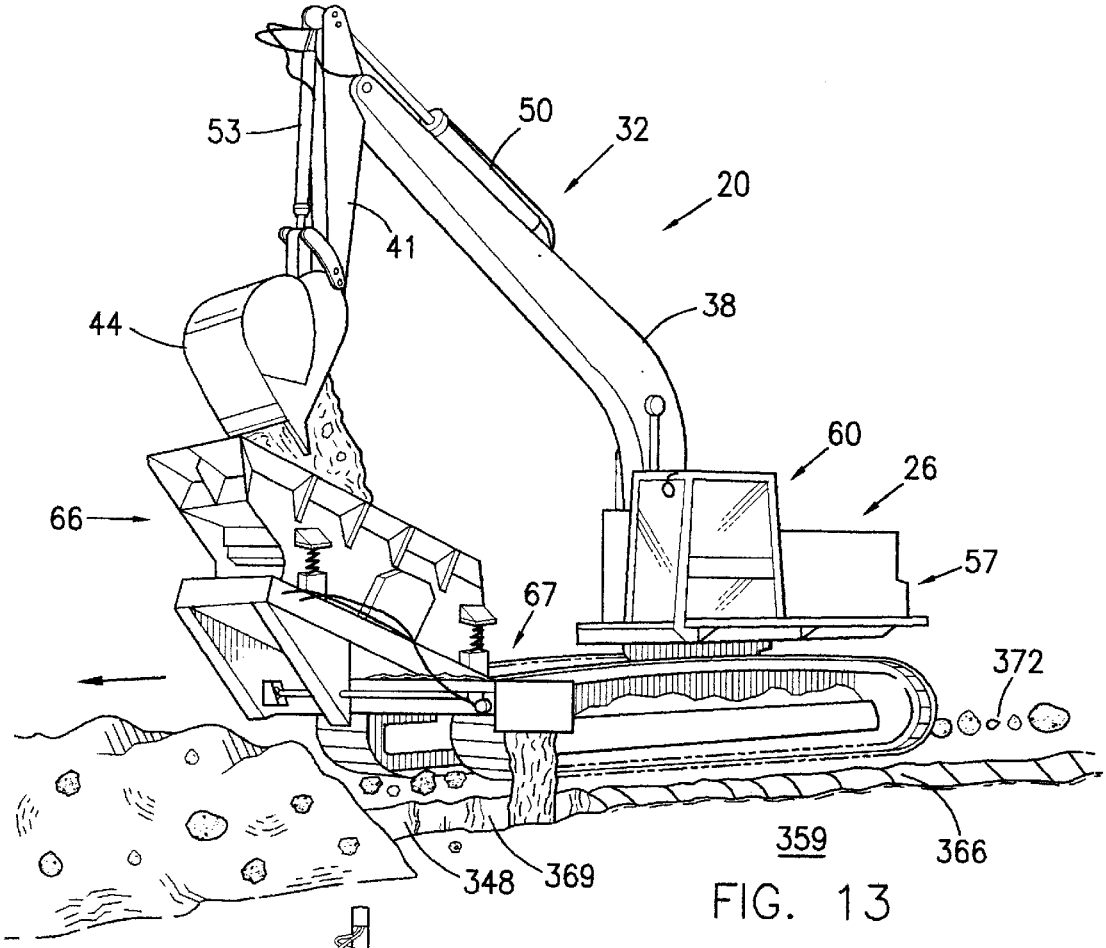

The best mode presently contemplated for carrying out the invention is illustrated in the accompanying drawings, in which:

FIG. 1 is a side elevational view of the pipeline padding machine of the invention;

FIG. 2, a top plan view of the pipeline padding machine showing the relationship between the spoils pile, the scooping bucket, the conveyor, and the padded pipeline during operation;

FIG. 3, a fragmentary top plan view of the lifting mechanism;

FIG. 4, a view taken on the line 4—4 of FIG. 3 showing the operation of the lifting mechanism;

FIG. 5, a fragmentary front elevational view of the conveyor and laterally movable frame;

FIG. 6, a top plan view of a wobbler sorter;

FIG. 7, a longitudinal vertical sectional view taken on the line 7—7 of FIG. 6 showing the chain interconnecting the sprockets of the wobblers, the relationship to the funnel and the conveyor, and the mountings for the wobbler sorter;

FIG. 8, a longitudinal vertical sectional view taken on the line 8—8 of FIG. 6 showing drive motor and the sprocket and chain drive for the wobblers;

FIG. 9, a top plan view of a vibratory sorter;

FIG. 10, a longitudinal vertical sectional view taken on the line 10—10 of FIG. 9 showing the spring mounting of the vibratory sorter, the eccentric disk, and housing therefore;

FIG. 11, a longitudinal vertical sectional view taken on the line 11—11 of FIG. 9 showing the hydraulic drive motor for the vibratory sorter;

FIG. 12, a top plan view of a variation of the vibratory sorter which utilizes a perforated plate;

FIG. 13, a front perspective view of the pipeline padding machine; and

Figure 14:
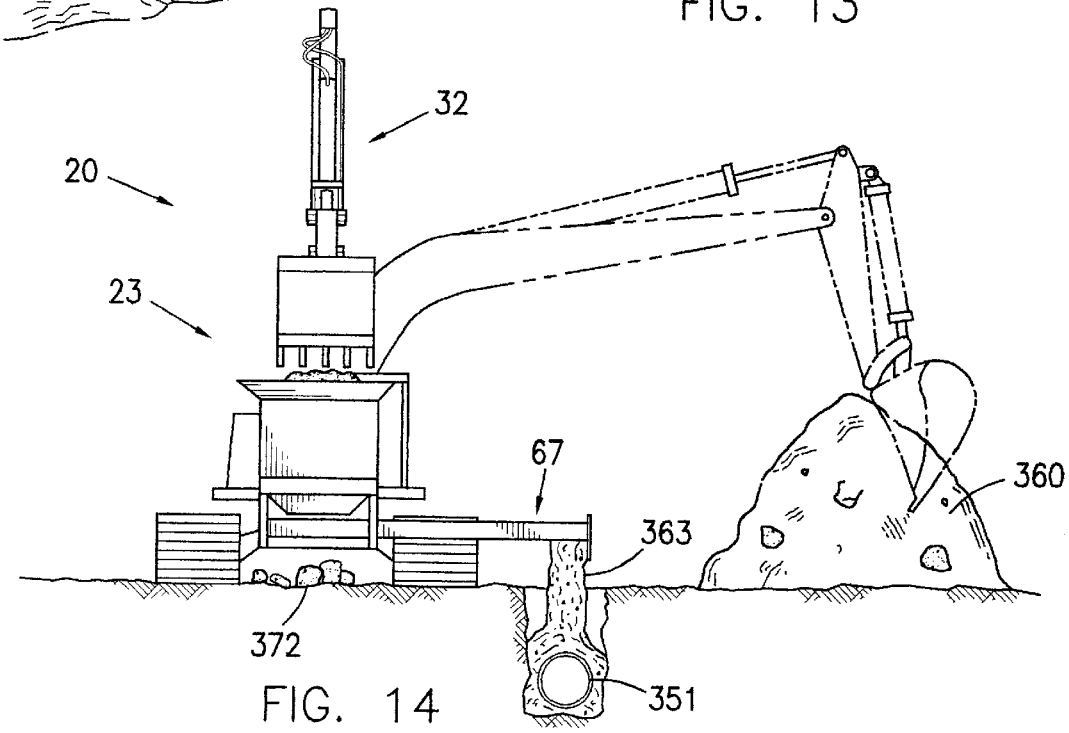

FIG. 14, a rear elevational view of the pipeline padding machine.

DETAILED DESCRIPTION OF THE PREFERRED EMBODIMENTS

Referring to FIGS. 1 and 2 therein is shown the pipeline padding machine of the invention. Padding machine 20 comprises a motorized vehicle, preferably an excavator 23 of the type having a rotatable body 26 mounted on a tracked undercarriage 29. A loading means comprising a hydraulically actuated extendible lifting arm 32 extends from and is pivotally mounted to a platform structure 35 of rotatable body 26. Lifting arm 32 includes a long arm 38, a short arm 41 pivotally mounted thereto, and a bucket 44 pivotally mounted thereto. Long arm 38 is pivotable vertically by means of a pair of hydraulic cylinders 47. Short extension arm 41 is pivotable by means of a hydraulic cylinder 50, and bucket 44 is pivotable by means of a hydraulic cylinder 53. The respective hydraulic cylinders 47, 50, and 53 are powered by means such as an integral engine-driven hydraulic pump unit (not shown) mounted on platform structure 35 in an engine housing 57 of rotatable body 26. A cab 60 mounted on platform structure 35 encloses the operator and controls (not shown) for the excavator 23. Body 26 is mounted to and rotates on a main pivot 63 which is mounted to undercarriage 29. Extendible lifting arm 32 can reach spoils material and other materials anywhere within the reach thereof whether ahead of, behind, or beside excavator 23.

Undercarriage 29 is preferably modified so as to be of a longer overall length than a conventional excavator so as to provide greater stability when a sorter means such as a wobbler sorter 66 and a conveyor means comprising a conveyor 67 are mounted thereto by an elevating means comprising an elevation mechanism 69. Such lengthening is designated "A" and is typically about six feet depending on the weight and placement of the sorter (FIG. 1). Such lengthening of undercarriage 29 helps to maintain an even front-to-rear balance of excavator 23 to further maintain stability thereof, particularly important in padding work done on up and down slopes and on side slopes. Undercarriage 29 comprises an extended main frame 72 to which main pivot 63 is connected and a pair of continuous cleated tracks 75 each are guided by and ride on a plurality of bogey wheels 78 connected to respective elongate side members 81, 82, 83, and 84 of main frame 72 and are powered by at least one of a pair of cog wheels 87 powered such as by hydraulic motors (not shown) by means of the engine driven hydraulic pump unit (not shown). Each of tracks 75 can be driven in a forward or reverse direction or stopped independently of the other of tracks 75 which allows maneuvering of excavator 23 by driving one or both of tracks 75 so as to skid tracks 75 and rotate excavator 23 and/or move in a forward or reverse direction.

Referring to FIGS. 3 and 4, the frame means comprises a main frame 90 having a pair of lifting arms 93 and 96 which have respective I-beam portions 99 and 102, and necked down portions 105 and 108, and main pivot brackets 109. A pair of triangular bumper arms 111 and 114 extend downwardly from lifting arms 93 and 96, respectively. Upper, middle, and lower cross members 117, 120, and 123, respectively, connect lifting arms 93 and 96, and bumper arms 111 and 114 together. Main frame 90 is pivotally mounted to side members 82 and 83 of main frame 72 by means of main pivot brackets 132 connected thereto and pins 135.

The elevation means comprises elevation mechanism 69 which comprises a pair of triangular cams or plates 138 are positioned on respective sides of each of necked down portions 105 and 108 and are pivotally mounted to frame members 82 and 83 of main frame 72 by means of secondary pivot brackets 139 and pins 141. A pair of links 142 connect pairs of plates 138 and necked-down portions 105 and 108 of lifting arms 93 and 96 by means of pins 143. A pair of dual action hydraulic lift cylinders 144, each having a body 147 and a rod 150 with rods 150 connected to respective pairs of triangular plates 138 by means of pins 153. Bodies 147 of cylinders 144 are pivotally connected to respective side members 82 and 83 of main frame 72 by means of respective brackets 156 and pins 159. By extending cylinders 144, triangular plates 138 rotate such that links 142 downwardly pull necked-down portions 105 and 108 of lifting arms 93 and 96 which pivot about pins 135 at main pivot brackets 132 vertically lifting sorter 66.

Referring to FIG. 5, the conveyor means comprises conveyor 67 which comprises a movable frame 186 and a motorized belt assembly 189. Frame 186 comprises a pair of parallel C-beams 192 and 195 interconnected by a plurality of cross members 198. Frame 186 is movably connected to main frame 90 by means of a plurality of rollers 201 connected to cross members 120 and 123 by means of a plurality of pins 204. C-beams 192 and 195 are movable on rollers 201 to extend conveyor 67 over a ditch (not shown) during use and retract to a laterally centered position relative to excavator 23 for periods of non-use for a more compact unit. Such movement is by means of a pair of hydraulic cylinders 207 each having a body 210 and a rod 213. Bodies 210 of cylinders 207 extend through and are attached to bumper arms 111 and 114 of main frame 90. Rods 213 of cylinders 207 are each pivotally connected to respective C-beams 192 and 195 by means of brackets 216 and pins 217. When hydraulic cylinders 207 extend, frame 186 and belt assembly 189 move laterally outwardly to a working position and when hydraulic cylinders 207 retract, frame 186 and belt assembly 189 move laterally inwardly to a more compact, stowed position.

Belt assembly 189 comprises a plurality of rollers 219 rotatably mounted on axles 222 with an elongate rubberized cloth belt 225 extending therearound. One of rollers 219 is driven by means of a hydraulic motor 228 so as to drive belt 225 to convey padding dirt (not shown) laterally from an outlet 231 of a funnel 234 under sorter 66 to a ditch (not shown). A deflector 237 can be attached to the distal ends of C-beams 192 and 195 by means of a bracket 240 to downwardly deflect padding dirt horizontally exiting belt 225, particularly at higher belt speeds.

Referring to FIGS. 6, 7, and 8, a first version, wobbler type sorter 66 includes a shell 243 having an upper hopper portion 246 and a lower body portion 249 which is attached to lifting arms 93 and 96 for movement therewith. A rock exit opening 252 in upper hopper portion 246 and lower body portion 249 is defined by a pair of inwardly extending flaps 255 and 258. Lower body portion 249 connects with an inlet 261 of funnel 234 so as to direct padding into funnel 234 and onto conveyor 67. A hydraulic motor 264 is mounted by means of a bracket 267 to lifting arm 93. A shroud 268 covers hydraulic motor 264. Sorter 66 includes a wobbler feeder 270 includes a frame 273 which fits within and is attached to upper hopper portion 246 such that rocks and dirt are funneled by upper hopper portion 246 into wobbler feeder 270. Wobbler feeder 270 further includes a plurality of parallel wobblers 276, each oblong in cross-section with a plurality of ribs 278 on the exterior thereof and rotatably mounted to frame 273. Wobblers 276 are oriented such that adjacent wobblers 276 are rotated ninety degrees relative to each other such that a constant gap distance "G" is maintained during rotation thereof (FIG. 6). Each wobbler 276 has a sprocket 279 which are rotated and maintained in the proper orientation by means of a continuous chain 282. Hydraulic motor 264 has a sprocket 285 and wobbler feeder 270 has a sprocket 288 which are interconnected by means of a continuous chain 291 such that wobblers 279 are driven in a synchronous fashion by hydraulic motor 264. Rocks and dirt are loaded into upper hopper portion 246 onto wobbler feeder 270. As wobblers 276 rotate the rocks and dirt are agitated and fed toward rock exit opening 252 with padding material comprising dirt, small rocks, and other such appropriately sized material falling through gaps "G", through lower body portion 249, through funnel 234 onto conveyor 67 for lateral transport to the ditch (not shown). Rocks and other such debris too large to pass through gaps "G" falls onto the ground through rock opening 252 between the tracks 75 of excavator 23 for later back filling of the ditch over the padded pipeline (not shown). While sorter 66 is shown with wobbler sorter 270 in a tilted position therein, a sorter such as sorter 66 can be designed such that wobbler sorter 270 is in a horizontal position with wobblers 276 moving the spoils material through residual material outlet 252.

Referring to FIGS. 9–11, a second version, vibrator type sorter 66A includes a shell 243A having an upper hopper portion 246A and a modified lower body portion 249A, which lower body portion 249A includes pairs of upper spring mounting brackets 294 on opposite sides thereof each of which correspond with a lower spring mounting bracket 297 of modified lift arms 93A and 96A. A compression spring 300 fits between each pair of upper and lower spring mounting brackets 294 and 297, respectively, such that modified shell 243A "floats" relative to a modified main frame 90A but still elevates and lowers therewith. Residual material exit opening 252 in upper hopper portion 246A and lower body portion 249A is defined by inwardly extending flaps 255 and 258. Lower body portion 249A connects with inlet 261 of funnel 234 so as to direct padding into funnel 234 and onto conveyor 67. Hydraulic motor 264 is mounted by means of bracket 267 to a lifting arm 93A. Sorter 66A includes a vibrator assembly 301 comprising a vibrator shaft 303 coupled at one end thereof by means of flexible coupling 306 to hydraulic motor 264 and at the opposite end thereof supported by a journal bearing 309 connected to a lifting arm 96A. An eccentric weight disk 312 is connected to vibrator shaft 303, with the longitudinal axis 315 of vibrator shaft 303 offset from the center 318 of weight disk 312 by a distance "D". Therefore, as hydraulic motor 264 drives eccentric weight disk 312 through coupling 306 and shaft 303, vibration is induced due to offset distance "D" which vibration is transferred through journal bearing 309 to lift arm 96A causing main frame 90A to vibrate (FIGS. 9 and 10). Such vibrations are transferred through upper and lower spring mounting brackets 294 and 297, and springs 300 to sorter 66A. The spring rates of springs 300, the weight of sorter 66A, the flexibility of main frame 90, the weight and offset "D" of eccentric disk 312, and the speed (revolutions per minute) of hydraulic motor 264 may be designed such that sorter 66A oscillates at a desired steady frequency. Sorter 66A further comprises a grizzly 321 comprising a plurality of elongate, tapered, T-shaped cross-section grizzly bars 324 supported by a plurality of support bars 327 attached to upper hopper portion 246A. Gaps 330 between grizzly bars 324 increase in width moving toward rock opening 252. Likewise, grizzly 321 slopes downwardly toward residual material exit opening 252 such that spoils material moves in that direction. A screen assembly 333 has a frame 336 attached at the edges thereof to upper hopper portion 246A, extending below and generally parallel to grizzly 321, and includes a screen mesh 339 having voids of the maximum size dirt, rocks, and other such materials desired to pass through as padding. Rocks and dirt are loaded into upper hopper portion 246A onto grizzly 321. As sorter 66A vibrates, the rocks, dirt, and other such spoils material are agitated and move toward rock exit opening 252 with appropriately sized dirt, rocks, and other such material falling through gaps 330 onto screen assembly 333 and continuing toward residual material exit opening 252. Rocks, dirt, and other such material smaller than the voids in screen assembly 333 fall through screen mesh 339, through body portion 249A, through funnel 234 onto conveyor 67 as padding material for lateral transport to the ditch (not shown). Rocks, dirt, and other such material too large to pass through gaps 330 fall onto the ground through residual material exit opening 252 between the tracks 75 of excavator 23 for later back filling onto the padded portion of the pipeline (not shown). Likewise, rocks, dirt, and other such material small enough to pass through gaps 330 of grizzly 321 but too large to pass through the voids in screen mesh 339 fall to the ground through rock opening 252 between the tracks 75 of excavator 23 for later back filling onto the padded portion of the pipeline. Alternatively, such rocks which pass through grizzly 321 but not through screen assembly 333 can be delivered to the already padded pipeline by means of a second conveyor (not shown) which is generally parallel to but rearward of conveyor 67, the padding protecting the pipeline from the larger rocks.

Referring to FIG. 12, grizzly 321 can be replaced by a thick, perforated plate grizzly 342 attached at the edges thereof to an upper hopper portion 246B of a modified sorter 66B, being typically of about one-inch thick steel having a plurality of holes therethrough such as hexagonal holes 345. Holes 345 are of such size as to pass only rocks of a desired size onto screen assembly 333, with rocks and other such debris too large to pass through holes 345 which falls onto the ground through residual material exit opening 252 between the tracks 75 of excavator 23 for later back filling onto the padded portion of the pipeline.

Referring to FIGS. 2, 13, and 14, therein is shown the padding machine 20 in operation as typically used to pad a pipeline. Padding machine 20 is positioned adjacent a ditch 348 in which a pipeline 351 is disposed, typically on a support structure such as sand bags (not shown). Padding machine 20 typically travels on a generally smooth first side 354 of ditch 348 with a second side 357 having a spoils pile 360. As such, extendible arm 32 of excavator 23 can reach across ditch 348 to scoop up a load of spoils material from spoils pile 360 and load such spoils material into sorter 66, without necessitating travelling on top of spoils pile 360. Padding material 363 separated from the spoils material by sorter 66 falls onto conveyor 67 and is conveyed onto pipeline 351 generally ahead of excavator 23 forming a padded portion 366 which remains adjacent padding machine 20 during normal single direction operation in the forward travel direction. The unpadded portion 369 of pipeline 351 remains generally ahead of excavator 23 such that any spoils or other material, particularly rocks, which may inadvertently be knocked onto pipeline 351 most likely will fall onto padded portion 366 rather than unpadded portion 369 with such padding material thereon protecting pipeline 351 from damage. As shown best in FIG. 2 (phantom lines), the placement of sorter 66 and conveyor 67 relative to extendible arm 32 on excavator 23 is such that the reach of extendible arm 32 is maintained behind unpadded portion 369 during the normal operation of padding machine 20.

Many variations of the pipeline padding machine and method of the invention can be made without departing from the inventive concept thereof. Examples include but are not limited to the motorized vehicle and loading means can be other than an excavator with extendible arm, for example a wheeled vehicle with an extendible arm or other loading means. A pair of powered or towed vehicles can be used, with the loading means on one vehicle and with the sorting means and conveying means on the other vehicle. A wheeled vehicle having an extendible arm or other such loading means can be used. The excavator can be replaced by a wheeled vehicle having a loading means such as an extendible arm. The conveyor means can be other than a belt type such as a downwardly angled chute with or without vibration means to maintain the flow of padding material into the ditch. The wobbler sorter can be disposed generally horizontally rather than at an angle using the wobblers to move the spoils material to the residual material exit opening. The sorters, particularly the vibratory type sorters, can be pivotally mounted to the lifting arms to allow pivotal movement during use such as for self-leveling thereof. A vibratory sorter can used which uses an offset or eccentric shaft rather than a separate rotating eccentric weight disk. The sorter can be other than of the vibratory or wobbler type with virtually any type of sorter possible now known or developed in the future.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A self-propelled pipeline padding machine for travelling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle which includes a pair of continuous, ground contacting tracks on which said vehicle travels, which tracks are movably mounted to an undercarriage of said vehicle;

a frame connected to an end of said vehicle;

a sorter supported at said end of said vehicle by said frame means which separates padding material from the spoils material leaving courser residual material including rocks, which residual material exits said sorter means at a residual material outlet, and a padding outlet from which the padding material exits said sorter;

a loading device attached to said vehicle of such configuration as to allow scooping up spoils material from the spoils pile on an opposite side of the ditch from the vehicle and dumping spoils material into said sorter;

a conveyor supported by said frame means which receives said padding material from said sorter means and which transports the padding material into the ditch to a side generally ahead of said motorized vehicle; and wherein the undercarriage and the tracks are extended longitudinally toward the sorter for increased stability of the vehicle.

2. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle;

a frame is movably mounted to an end of said vehicle;

a sorter supported at the end of said vehicle by said frame which separates padding material from the spoils material leaving courser residual material including rocks, which residual material exits said sorter at a residual material outlet, and a padding outlet from which the padding material exits said sorter;

a loading device attached to said vehicle of such configuration as to allow scooping up spoils material from the spoils pile on an opposite side of the ditch from the vehicle and dumping spoils material into said sorter;

a conveyor supported by said frame which receives said padding material from said sorter and which transports the padding material into the ditch to a side generally ahead of said motorized vehicle; and wherein an elevating device vertically moves said frame and sorter relative to said vehicle.

3. A pipeline padding machine according to claim 2, wherein:

the frame is pivotally mounted to the vehicle at an end thereof adjacent said vehicle; and the elevating device includes at least one hydraulic cylinder having opposite ends thereof attached to said frame and to said vehicle, respectively.

4. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motor vehicle;

a frame means connected to an end of said vehicle;

a sorter means supported at said end of said vehicle by said frame means which separates padding material from the spoils material leaving courser residual material including rocks, which residual material exits said sorter means at a residual material outlet, and a padding outlet from which the padding material exits said sorter means;

a loading means attached to said vehicle of such configuration as to allow scooping up spoils material from the spoils pile on an opposite side of the ditch from said vehicle and dumping spoils material into said sorter means;

a conveyor means supported by said frame means which receives said padding material from said sorter means and which transports the padding material into the ditch to a side generally ahead of said vehicle; and wherein said frame means is movably mounted to said vehicle and an elevating means vertically moves said frame means and said sorter means relative to said vehicle, said frame means being pivotally mounted to said vehicle at an end thereof adjacent said vehicle and said elevating means including at least one hydraulic cylinder having opposite ends thereof attached to said frame means and to said vehicle, respectively, and wherein said elevating means includes a cam pivotally connected to said vehicle at an undercarriage thereof, to an end of said hydraulic cylinder, and through a link to said frame means such that movement of said hydraulic cylinder changes the position of said frame means.

5. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle;

a frame connected to an end of said vehicle;

a wobbler sort supported at said end of said vehicle by said frame which separates padding material from the spoils material leaving coarser residual material including rocks, which residual material exits said sorter at a residual material outlet, and a padding outlet from which the padding material exits said sorter;

a loading device attached to said vehicle of such configuration as to allow scooping up spoils material from the spoils pile on an opposite side of the ditch from the vehicle and dumping spoils material into said sorter; and a conveyor supported by said frame which receives said padding material from said sorter and which transports the padding material into the ditch to a side generally ahead of said motorized vehicle.

6. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle;

a frame connected to an end of said vehicle;

a sorter supported at said end of said vehicle by said frame which separates padding material from the spoils material leaving courser residual material including rocks, which residual material exits said sorter at a residual material outlet, and a padding outlet from which the padding material exits said sorter;

a loading device attached to said vehicle of such configuration as to allow scooping up spoils material from the spoils pile on an opposite side of the ditch from the vehicle and dumping spoils material into said sorter, said loading device comprising a rotatable, extendible arm with scooping bucket, which arm is mounted to the vehicle and is hydraulically powered by said vehicle;

a conveyor supported by said frame which receives said padding material from said sorter and which transports the padding material into the ditch to a side generally ahead of said motorized vehicle; and wherein said vehicle includes a pair of continuous, ground contacting tracks on which said vehicle travels, which tracks are movably mounted to an undercarriage of said vehicle, said residual material outlet deposits the residual material onto a ground surface between said tracks, and said undercarriage and said tracks are extended longitudinally toward said sorter for increased stability of said vehicle.

7. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle;

a frame connected to an end of said vehicle;

a sorter supported at said end of said vehicle by said frame which separates padding material from the spoils material leaving coarser residual material including rocks, which residual material exits said sorter at a residual material outlet, and a padding outlet from which the padding material exits said sorter;

a loading device attached to said vehicle of such configuration as to allow scooping up spoils material from the spoils pile on an opposite side of the ditch from the vehicle and dumping spoils up material into said sorter, said loading device comprising a rotatable, extendible arm with scooping bucket, which arm is mounted to said vehicle and is hydraulically powered by said vehicle;

a conveyor supported by said frame which receives said padding material from said sorter and which transports the padding material into the ditch to a side generally ahead of said motorized vehicle; and wherein said vehicle includes a pair of continuous, ground contacting tracks on which said vehicle travels, which tracks are movably mounted to an undercarriage of said vehicle, said residual material outlet which deposits the residual material onto a ground surface between said tracks, said frame being movably mounted to said vehicle, and elevating device moves said frame relative to said vehicle.

8. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle;

a frame means connected to an end of said vehicle;

a sorter means supported at said end of said vehicle by said frame means which separates padding material from the spoils material leaving coarser residual material including rocks, which residual material exits said sorter means at a residual material outlet, and a padding outlet from which the padding material exits said sorter means;

a loading means attached to said vehicle of such configuration as to allow scooping up spoils material from the spoils pile on an opposite side of the ditch from said vehicle and dumping spoils material into said sorter means;

a conveyor means supported by said frame means which receives said padding material from said sorter means and which transports the padding material into the ditch to a side generally ahead of said vehicle; and wherein said loading means comprises a rotatable, extendible arm with scooping bucket, which arm is mounted to said vehicle and which is hydraulically powered by said vehicle, said vehicle including a pair of continuous, ground contacting tracks on which said vehicle travels, which tracks are movably mounted to an undercarriage of said vehicle and said residual material outlet deposits the residual material onto a ground surface between said tracks, wherein said frame means is movably mounted to said vehicle and an elevating means moves said frame means relative to said vehicle, and wherein said frame means is pivotally mounted to said vehicle at an end opposite said sorter, and said elevating means includes at least one hydraulic cylinder having opposite ends thereof attached to said frame means and to said vehicle, respectively.

9. A pipeline padding machine according to claim 8, wherein the elevating means includes a cam pivotally connected to the vehicle at an undercarriage thereof, to an end of the hydraulic cylinder, and through a link to the frame means such that movement of said hydraulic cylinder changes the position of said frame means.

10. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle;

a frame connected to an end of said vehicle;

a wobbler sorter supported at said end of said vehicle by said frame which separates padding material from the spoils material leaving coarser residual material including rocks, which residual material exits said sorter at a residual material outlet, and a padding outlet from which the padding material exits said sorter;

a loading device attached to said vehicle of such configuration as to allow scooping up spoils material from the spoils pile on an opposite said of the ditch from the vehicle and dumping spoils material into said sorter, said loading device comprising a rotatable, extendible arm with scooping bucket, which arm is mounted to said vehicle and is hydraulically powered by said vehicle;

a conveyor supported by said frame which receives said padding material from said sorter and which transports the padding material into the ditch to a side generally ahead of said motorized vehicle; and wherein said vehicle includes a pair of continuous, ground contacting tracks on which said vehicle travels, which tracks are movably mounted to an undercarriage of said vehicle, said residual material outlet which deposits the residual material onto a ground surface between said tracks.

11. A method for padding pipelines disposed in an elongate ditch with spoils material removed during digging thereof being in an elongate, generally continuous spoils pile or a series of spoils piles alongside the ditch, the method which utilizes a motorized padding machine comprising an excavator having a tracked undercarriage with a rotatable operator cabin and extendible loading arm with a scooping bucket mounted thereto, and having a powered sorter mounted at an end thereof on a frame mounted to an end portion of the excavator, the sorter being for sorting padding material for separate discharge from coarser residual material including rocks having a separate discharge, and a laterally disposed conveyor which conveys padding material from the sorter into the ditch on a pipeline therein ahead of the padding machine, and a residual material outlet for depositing residual material on a ground surface between respective tracks of the padding machine, the method comprising the steps of:

moving the padding machine alongside the ditch on a side thereof opposite a side on which the spoils pile is disposed, traveling generally parallel to the ditch in such a direction wherein the sorter and the conveyor are generally ahead of the excavator;

loading spoils material into the sorter by reaching across the ditch with the extendible loading arm of the excavator, scooping up spoils material from the spoils pile using the scooping bucket, retracting the arm back across the ditch prior to dumping spoils material within the scooping bucket into the sorter, and dumping spoils material within the scooping bucket into the sorter;

separating padding material from spoils material using the sorter and separately discharging the padding material from residual material; and conveying the padding material discharged from the sorter onto a pipeline within the ditch, wherein due to the mounting of the sorter at the end of the excavator and a direction of travel of the tractor toward the sorter, the excavator being disposed adjacent a portion of the pipeline already covered with padding material rather than an unpadded portion thereof, the scooping bucket of the excavator which remains mostly over and adjacent the padded portion of the pipeline during use rather than the unpadded portion thereof such that any rocks inadvertently dropped from or knocked into the ditch by the scooping bucket fall mostly on the padded portion of the pipeline so as not to damage the pipeline or a coating thereon.

12. A method according to claim 11, wherein:

the method is conducted using a pipeline padding machine wherein the sorter is mounted at a front end of the excavator; and the step of moving the pipeline padding machine alongside the ditch is done in a forward direction.

13. A method according to claim 12, wherein the method is conducted using a pipeline padding machine wherein the undercarriage and respective tracks of the excavator are extended longitudinally toward the front of the excavator for increased excavator stability.

14. A method according to claim 12, wherein:

the method is conducted using a pipeline padding machine wherein the frame is movably mounted to the vehicle such that the vertical position of the sorter relative to the ground surface on which the pipeline padding machine travels is adjustable; and further including the step of adjusting the vertical position of the sorter relative to the ground surface by raising and lowering the sorter to provide clearance between the ground surface and the sorter during use thereof.

15. A method according to claim 11, wherein:

the method is conducted using a pipeline padding machine wherein the sorter is mounted on the frame to the excavator in a position generally centered about a longitudinal centerline of the excavator, with the residual material discharge of the sorter also located generally centered about the longitudinal centerline thereof; and the step of separating padding material from the spoils material using the sorter and separately discharging the padding material and the residual material includes depositing the residual material through the residual material discharge between respective tracks of the excavator.

16. A method for padding pipelines disposed in an elongate ditch with spoils material removed during digging thereof being in an elongate, generally continuous spoils pile or a series of spoils piles alongside the ditch, the method which utilizes a motorized padding machine comprising an excavator having a tracked undercarriage with a rotatable operator cabin and extendible loading arm with a scooping bucket mounted thereto, and having a powered sorter mounted at an end thereof on a frame mounted to an end portion of the excavator, the sorter being for sorting padding material for separate discharge from coarser residual material including rocks having a separate discharge, and a laterally disposed conveyor which conveys padding material from the sorter into the ditch on a pipeline therein ahead of the padding machine, and a residual material outlet for depositing residual material on a ground surface between respective tracks of the padding machine, the method comprising the steps of:

moving the padding machine alongside the ditch on a side thereof opposite a side on which the spoils pile is disposed, travelling generally parallel to the ditch in such a direction wherein the sorter and the conveyor are generally ahead of the excavator;

loading spoils material into the sorter by reaching across the ditch with the extendible loading arm of the excavator, scooping up spoils material from the spoils pile using the scooping bucket, retracting the arm back across the ditch prior to dumping spoils material within the scooping bucket into the sorter, and dumping spoils material within the scooping bucket into the sorter;

separating padding material from spoils material using the sorter and separately discharging the padding material from residual material; and conveying the padding material discharged from the sorter onto a pipeline within the ditch, wherein due to the mounting of the sorter at the end of the excavator and a direction of travel of the tractor toward the sorter, the excavator being disposed adjacent a portion of the pipeline already covered with padding material rather than an unpadded portion thereof, the scooping bucket of the excavator which remains mostly over and adjacent the padded portion of the pipeline during use rather than the unpadded portion thereof such that any rocks inadvertently dropped from or knocked into the ditch by the scooping bucket fall mostly on the padded portion of the pipeline so as not to damage the pipeline or a coating thereon; and wherein the method is conducted using a pipeline padding machine wherein the sorter is mounted at a front end of the excavator and the step of moving the pipeline padding machine alongside the ditch is done in a forward direction, the method is conducted using a pipeline padding machine wherein the frame is movably mounted to the vehicle such that the vertical position of the sorter relative to the ground surface on which the pipeline padding machine travels is adjustable and further including the step of adjusting the vertical position of the sorter relative to the ground surface by raising and lowering the sorter to provide clearance between the ground surface and the sorter during use thereof, and wherein the method is conducted using a pipeline padding machine wherein the frame supporting the sorter is pivotally mounted to the excavator at an end thereof adjacent the excavator and the step of adjusting the vertical position of the sorter relative to the ground surface is done by the frame with attached sorter upwardly and downwardly so as to raise and lower the sorter relative to the ground surface.

17. A method for padding pipelines disposed in an elongate ditch with spoils material removed during digging thereof being in an elongate, generally continuous spoils pile or a series of spoils piles alongside the ditch, the method which utilizes a motorized padding machine comprising an excavator having a tracked undercarriage with rotatable operator cabin and extendible loading arm with a scooping bucket mounted thereto, and having a powered sorter mounted at an end thereof on a frame mounted to an end portion of the excavator, the sorter being for sorting padding material for separate discharge from coarser residual material including rocks having a separate discharge, and a laterally disposed conveyor which conveys padding material from the sorter into the ditch on a pipeline therein ahead of the padding machine, and a residual material outlet for depositing residual material on a ground surface between respective tracks of the padding machine, the method comprising the steps of:

moving the padding machine alongside the ditch, traveling generally parallel to the ditch in such a direction wherein the sorter and the conveyor are generally ahead of the excavator;

loading spoils material into the sorter by reaching with the arm of the excavator, scooping up spoils material from the spoils pile using the scoop bucket, retracting the arm, and dumping spoils material within the scooping bucket into the sorter;

separating padding material from spoils material using the sorter and separately discharging the padding material from residual material;

conveying the padding material discharged from the sorter onto a pipeline within the ditch, wherein due to the mounting of the sorter at the end of the excavator and a direction of travel of the tractor toward the sorter, the excavator being disposed adjacent a portion of the pipeline already covered with padding material rather than an unpadded portion thereof, the scooping bucket of the excavator which remains mostly over and adjacent the padded portion of the pipeline during use rather than the unpadded portion thereof such that any rocks inadvertently dropped from or knocked into the ditch by the scooping bucket fall mostly on the padded portion of the pipeline so as not to damage the pipeline or a coating thereon; and wherein the method is conducted using a pipeline padding machine wherein the sorter is mounted at a front end of the excavator, and the step of moving the pipeline padding machine alongside the ditch is done in a forward direction.

18. A method according to claim 17, wherein the method is conducted using a pipeline padding machine wherein the undercarriage and respective tracks of the excavator are extended longitudinally toward a front end of the excavator for increased excavator stability.

19. A method for padding pipelines disposed in an elongate ditch with spoils material removed during digging thereof being in an elongate, generally continuous spoils pile or a series of spoils piles alongside the ditch, the method which utilizes a motorized padding machine comprising an excavator having a tracked undercarriage with a rotatable operator cabin and extendible loading arm with a scooping bucket mounted thereto, and having a powered sorter mounted at an end thereof on a frame mounted to an end portion of the excavator, the sorter being for sorting padding material for separate discharge from coarser residual material including rocks having a separate discharge, and a laterally disposed conveyor which conveys padding material from the sorter into the ditch on a pipeline therein ahead of the padding machine, and a residual material outlet for depositing residual material on a ground surface between respective tracks of the padding machine, the method comprising the steps of:

moving the padding machine alongside the ditch, travelling generally parallel to the ditch in such a direction wherein the sorter and the conveyor are generally ahead of the excavator;

loading spoils material into the sorter by reaching with the arm of the excavator, scooping up spoils material from the spoils pile using the scooping bucket, retracting the arm, and dumping spoils material within the scooping bucket into the sorter;

separating padding material from spoils material using the sorter and separately discharging the padding material from residual material; and conveying the padding material discharged from the sorter onto a pipeline within the ditch, wherein due to the mounting of the sorter at the end of the excavator and a direction of travel of the tractor toward the sorter, the excavator being disposed adjacent a portion of the pipeline already covered with padding material rather than an unpadded portion thereof, the scooping bucket of the excavator which remains mostly over and adjacent the padded portion of the pipeline during use rather than the unpadded portion thereof such that any rocks inadvertently dropped from or knocked into the ditch by the scooping bucket fall mostly on the padded portion of the pipeline so as not to damage the pipeline or a coating thereon; and wherein the method is conducted using a pipeline padding machine wherein the frame is movably mounted to the excavator such that a vertical position of the sorter relative to the ground surface on which the pipeline padding machine travels is adjustable, and further including the step of adjusting the vertical position of the sorter relative to the ground surface by raising and lowering the sorter to provide clearance between the ground surface and the sorter during the use thereof.

20. A method according to claim 19, wherein:

the method is conducted using a pipeline padding machine wherein the frame supporting the sorter is pivotally mounted to the excavator at an end thereof adjacent the excavator; and the step of adjusting the vertical position of the sorter relative to the ground surface is done by pivoting the frame with attached sorter upwardly and downwardly so as to raise and lower the sorter relative to the ground surface.

21. A method for padding pipelines disposed in an elongate ditch with spoils material removed during digging thereof being in an elongate, generally continuous spoils pile or a series of spoils piles alongside the ditch, an unpadded portion of the pipeline being uncovered and a padded portion of the pipeline being covered with padding material, comprising the steps of:

scooping up spoils material from the spoils pile adjacent the padded portion of the pipeline, moving the spoils material to a sorter, and depositing the spoils material into the sorter by use of an extendible arm having a scooping bucket at an end thereof:

separating padding material from residual material including rocks inside the sorter positioned adjacent the padded portion of the pipeline;

conveying the padding material from the sorter into the ditch on top of the unpadded portion of the pipeline, overlapping the padded portion of the pipeline immediately adjoining the unpadded portion of the pipeline;

wherein the steps are conducted while moving alongside the ditch traveling generally parallel to the ditch in a predetermined direction so as to remain adjacent the padded portion of the pipeline such that rocks which are inadvertently knocked into the ditch primarily land on the padded portion of the pipeline so as to not damage the pipeline and any protective coating thereon; and wherein all of the steps of the method are conducted using a single pipeline padding machine capable of performing all of the steps, and with the pipeline padding machine on an opposite side of the ditch from a side on which the spoils pile is disposed.

22. A method for padding pipelines disposed in an elongate ditch with spoils material removed during digging thereof being in an elongate, generally continuous spoils pile or a series of spoils piles alongside the ditch, an unpadded portion of the pipeline being uncovered and a padded portion of the pipeline being covered with a padding material, comprising the steps of:

scooping up spoils material from the spoils pile adjacent the padded portion of the pipeline, moving the spoils material to a sorter, and depositing the spoils material into the sorter using an extendible arm having a scooping bucket at an end thereof;

separating padding material from residual material including rocks inside the sorter positioned adjacent the padded portion of the pipeline;

conveying the padding material from the sorter into the ditch on top of the unpadded portion of the pipeline, overlapping the padded portion of the pipeline immediately adjoining the unpadded portion of the pipeline;

wherein the steps are conducted while moving alongside the ditch traveling generally parallel to the ditch in a predetermined direction so as to remain adjacent the padded portion of the pipeline such that rocks which are inadvertently knocked into the ditch primarily land on the padded portion of the pipeline so as not to damage the pipeline and any protective coating thereon, all of the steps of the method are conducted using a single pipeline padding machine capable of performing all of the steps, and further including the step of adjusting a vertical position of the sorter relative to a ground surface by raising and lowering the sorter to provide clearance between the ground surface and the sorter during use thereof.

23. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle;

a frame connected to an end of said vehicle;

a sorter supported at said end of said vehicle by said frame which separates padding material from the spoils material leaving coarser residual material including rocks, which residual material exits said sorter at a residual material outlet, and a padding outlet from which the padding material exits said sorter;

a loading device attached to said vehicle of such configuration as to allow scooping up spoils material from the spoils pile on an opposite side of the ditch from said vehicle and dumping spoils material into said sorter;

a conveyor supported by said frame which receives said padding material from said sorter and which transports the padding material into the ditch to a side generally ahead of said vehicle; and wherein said frame is movably mounted to said vehicle and an elevating device vertically moves to said sorter relative to said vehicle, said frame being pivotally mounted to said vehicle at an end thereof adjacent said vehicle and said elevating device including at least one hydraulic cylinder having opposite ends thereof attached to said frame and to said vehicle, respectively, and wherein said elevating device includes a cam pivotally connected to said vehicle at an undercarriage thereof; to an end of said hydraulic cylinder, and through a link to said frame such that movement of said hydraulic cylinder changes the position of said frame.

24. A self-propelled pipeline padding machine for traveling alongside an elongate ditch containing a pipeline to be padded, spoils material which was removed from the ditch during digging thereof being in an elongate spoils pile on an opposite side of the ditch, the pipeline padding machine which scoops up and separates padding material from the spoils material, leaving coarser residual material including rocks, and which conveys the padding material into the ditch on top of the pipeline, comprising:

a motorized vehicle;

a frame connected to an end of said vehicle;

a sorter supported at end of said vehicle by said frame which separates padding material from the spoils material leaving courser residual material including rocks, which residual material exits said sorter at a residual material outlet, and a padding outlet from which the padding material exits said sorter;

a loading device attached to said vehicle of such configuration as to allow scooping up spoils material from the spoils pile on an opposite side of the ditch from said vehicle and dumping spoils material into said sorter;

a conveyor supported by said frame which receives said padding material from said sorter and which transports the padding material into the ditch to a side generally ahead of said vehicle; and wherein said loading device comprises a rotatable, extendible arm with scooping bucket, which arm is mounted to said vehicle and which is hydraulically powered by said vehicle, said vehicle including a pair of continuous, ground contacting tracks on which said vehicle travels, which tracks are movably mounted to an undercarriage of said vehicle and said residual material outlet deposits the residual material onto a ground surface between said tracks, wherein said frame is movably mounted to said vehicle and an elevating device moves said frame relative to said vehicle, and wherein said frame is pivotally mounted to said vehicle at an end opposite said sorter, and said elevating device includes at least one hydraulic cylinder having opposite ends thereof attached to said frame and to said vehicle, respectively.

25. A pipeline padding machine according to claim 24, wherein the elevating device includes a cam pivotally connected to the vehicle at an undercarriage thereof, to an end of the hydraulic cylinder, and through a link to the frame such that movement of said hydraulic cylinder changes the position of said frame.

26. A method for padding pipelines disposed in an elongate ditch with spoils material removed during digging thereof being in an elongate, generally continuous spoils pile or a series of spoils piles alongside the ditch, the method which utilizes a motorized padding machine comprising an excavator having a tracked undercarriage with a rotatable operator cabin and extendible loading arm with a scooping bucket mounted thereto, and having a powered sorter mounted at an end thereof on a frame mounted to an end portion of the excavator, the sorter being for sorting padding material for separate discharge from coarser residual material including rocks having a separate discharge, and a laterally disposed conveyor which conveys padding material from the sorter into the ditch on a pipeline therein ahead of the padding machine, and a residual material outlet for depositing residual material on a ground surface between respective tracks of the padding machine, the method comprising the steps of:

moving the padding machine alongside the ditch on a side thereof opposite a side on which spoils pile is disposed, traveling generally parallel to the ditch in such a direction wherein the sorter and the conveyor are generally ahead of the excavator.

loading spoils material into the sorter by reaching across the ditch with the extendible loading arm of the excavator, scooping up spoils material form the spoils pile using the scooping bucket, retracting the arm back across the ditch prior to dumping spoils material within the scooping bucket into the sorter, and dumping spoils material within the scooping bucket into the sorter;

separating padding material from spoils material using the sorter and separately discharging the padding material from residual material;

conveying the padding material discharged from the sorter onto a pipeline within the ditch, wherein due to the mounting of the sorter at the end of the excavator and a direction of travel of the tractor toward the sorter, the excavator being disposed adjacent a portion of the pipeline already covered with padding material rather than an unpadded portion thereof, the scooping bucket of the excavator which remains mostly over and adjacent the padded portion of the pipeline during use rather than the unpadded portion thereof such that any rocks inadvertently dropped from or knocked into the ditch by the scooping bucket fall mostly on the padded portion of the pipeline so as not to damage the pipeline or a coating thereon; and wherein the method is conducted using a pipeline padding machine wherein the sorter is mounted at a front end of the excavator and the step of moving the pipeline padding machine alongside the ditch is done in a forward direction, the method is conducted using a pipeline padding machine wherein the frame is movably mounted to the vehicle such that the vertical position of the sorter relative to the ground surface on which the pipeline padding machine traveling adjustable and further including the step of adjusting the vertical position of the sorter relative to the ground surface by raising and lowering the sorter to provide clearance between the ground surface and the sorter during use thereof, and wherein the method is conducted using a pipeline padding machine wherein the frame supporting the sorter is pivotally mounted to the excavator at an end thereof adjacent the excavator and the step of adjusting the vertical position of the sorter relative to the ground surface is done by pivoting the frame with attached sorter upwardly and downwardly so as to raise and lower the sorter relative to the ground surface.

* * * * *